United States Patent [19]

Giles et al.

[11] 4,122,941

[45] Oct. 31, 1978

[54] MACHINE FOR THE PREPARATION OF PACKS OF ARTICLES OF A PRE-DETERMINED WEIGHT

[75] Inventors: Alan F. Giles, Welwyn Garden City, England; Albertus G. Hendriks, Vlaardingen, Netherlands

[73] Assignee: Internationale Octrooi Maatschappij "OCTROPA" B.V., Rotterdam, Netherlands

[21] Appl. No.: 780,791

[22] Filed: Mar. 23, 1977

[51] Int. Cl.[2] ..... B65G 25/02; B65G 47/10; G01G 13/34

[52] U.S. Cl. ..... 198/774; 198/358; 198/420; 198/505

[58] Field of Search ..... 198/356, 419, 420, 504, 198/505, 774, 358, 362, 365; 214/2, 11 R; 209/121, 74 R; 177/145

[56] References Cited

U.S. PATENT DOCUMENTS

| | | | |
|---|---|---|---|
| 3,011,621 | 12/1961 | Byrnes et al. | 198/358 X |
| 3,221,870 | 12/1965 | Pagay | 198/774 |
| 3,416,646 | 12/1968 | Boos et al. | 198/774 |
| 3,554,363 | 1/1971 | Elineau | 198/774 |
| 3,557,942 | 8/1968 | Simon et al. | 198/774 |
| 3,662,876 | 5/1972 | Hollis | 198/774 X |
| 3,736,997 | 6/1973 | Bottorf | 214/2 X |
| 3,762,538 | 10/1973 | Buchheit | 198/774 |
| 3,825,109 | 7/1974 | Stockbridge | 198/774 |
| 3,834,515 | 9/1974 | Bajcar et al. | 198/505 X |

*Primary Examiner*—Evon C. Blunk
*Assistant Examiner*—James L. Rowland
*Attorney, Agent, or Firm*—Barry Kramer

[57] ABSTRACT

A machine for weighing and sorting articles to make up packs of a pre-determined weight with the aid of a computer. The improvement is a particular drive mechanism for feeding the articles to a series of weigh heads and then on therefrom. The drive mechanism splits the motion into two components, preferably simple harmonic motions, one of which is a continuously operating vertical reciprocation and the other is a selectively actuated horizontal reciprocation.

2 Claims, 13 Drawing Figures

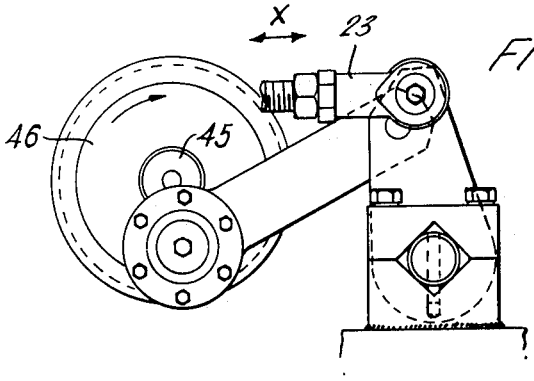
FIG. 8.
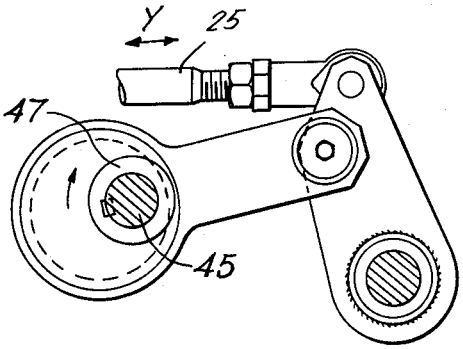
FIG. 9.
FIG. 10.
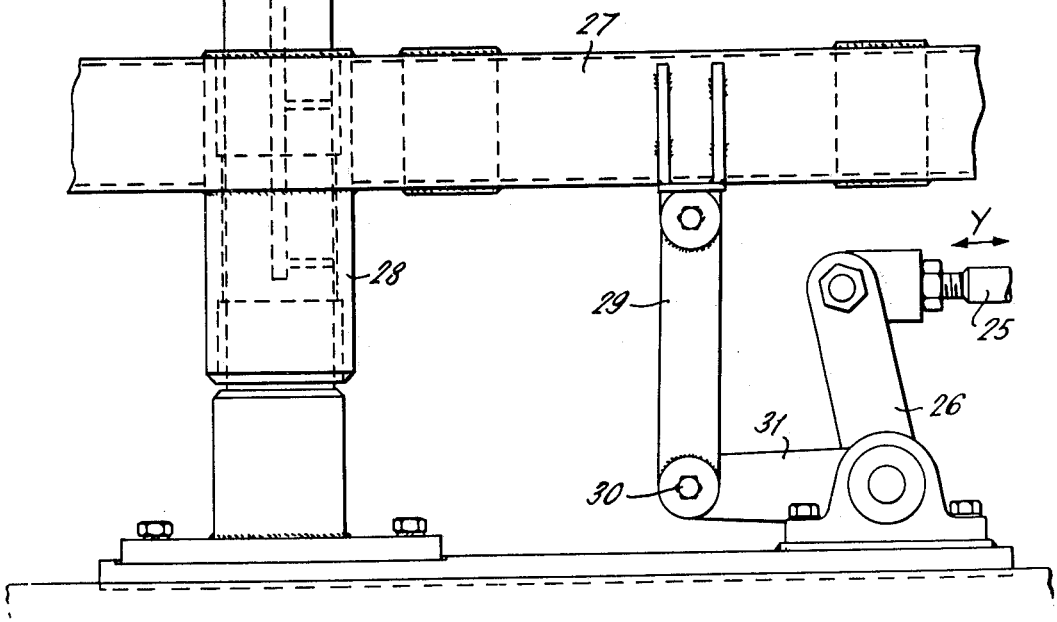

FIG. 11.
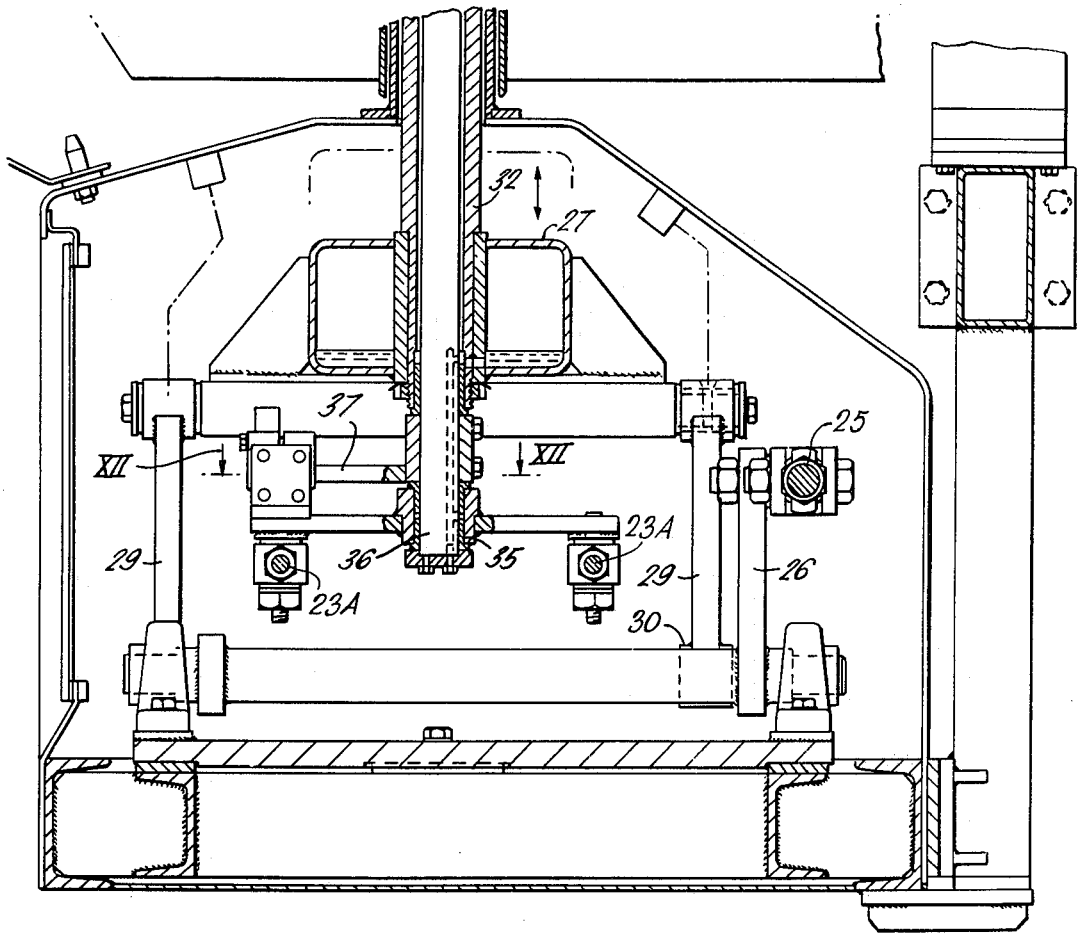
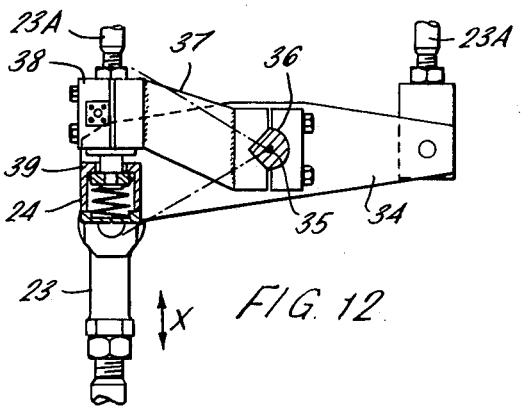
FIG. 12

MACHINE FOR THE PREPARATION OF PACKS OF ARTICLES OF A PRE-DETERMINED WEIGHT

The present invention relates to the preparation of packs of articles of a pre-determined weight.

At a lecture given at the Institute of Electrical Engineers in London in February 1964 and published in an article in Electrical Supervisor of May 1964, Dr. H. A. Thomas described a weighing method where a computer was used to select from a given number of previously weighed articles, a smaller number of such articles whose total weight came as nearly as possible to a pre-determined weight, where a small overweight was permissible but no underweight was allowed. This enabled packs to be produced to a given target weight within a fairly narrow tolerance, where individual portions within that pack varied in weight by a greater amount.

This so-called computer weigh sorting method had previously been suggested in an article by A. F. Giles in Instrument Review of November 1963 at page 1210, and subsequently a machine was designed for weigh-sorting of fish fillets and has been described in general terms in the April 1975 issue of Food Processing.

The present invention provides a feeding mechanism for use in such a machine.

Accordingly, the invention provides a weigh sorting machine comprising a plurality of weigh platforms, a corresponding plurality of feed stations, and a feed mechanism which is arranged to feed pack units singly from each feed station to each weigh platform and onwards from each weigh platform, said feed mechanism including two drive mechanisms, a first being arranged to provide a vertical movement to continuously raise and lower all the pack units at all feed stations and weigh platforms, and the second being arranged, on selective actuation, to provide for each feed station a separate controlled horizontal movement dependent on the selective actuation for transferring the selected pack units only from the feed stations to the weigh platforms and onwards therefrom to form a complete pack formed from the selected pack units.

By the term pack unit we mean an article or group of articles of which several such units make up a pack, but each article or group of articles can be handled and weighed as one.

Preferably, the separate horizontal movements are controlled by, in each case, an electro-magnetic clutch. Then, when the computer selects any particular weighed pack unit to be transferred, actuation of the feed mechanism appropriate to the weigh platform corresponding to that pack unit can be effected by an electrical signal from the computer.

Preferably, the horizontal and vertical movements are simple harmonic motions, and preferably each feed mechanism comprises a pair of concentric shafts driven by said two drive mechanisms, one of said shafts being vertically reciprocal to provide vertical movements of the pack units, and the other shaft being capable of rotary movement and connected to a lever, movement of which lever through rotation of the rotary shaft causes said horizontal movement.

An embodiment of the invention will now be described by way of example with reference to the accompanying diagrammatic drawings, in which FIG. 1 is an overall plan view of the machine;

FIGS. 8 and 9 show the drive mechanism prime mover linkages;

FIG. 10 shows a side view of the vertical drive mechanism;

FIG. 11 shows a sectional end elevation of the lift mechanism;

FIG. 12 shows a sectional plan view of the clutch mechanism for the horizontal drive sectioned on the lines XII—XII of FIG. 11.

Figure 1:
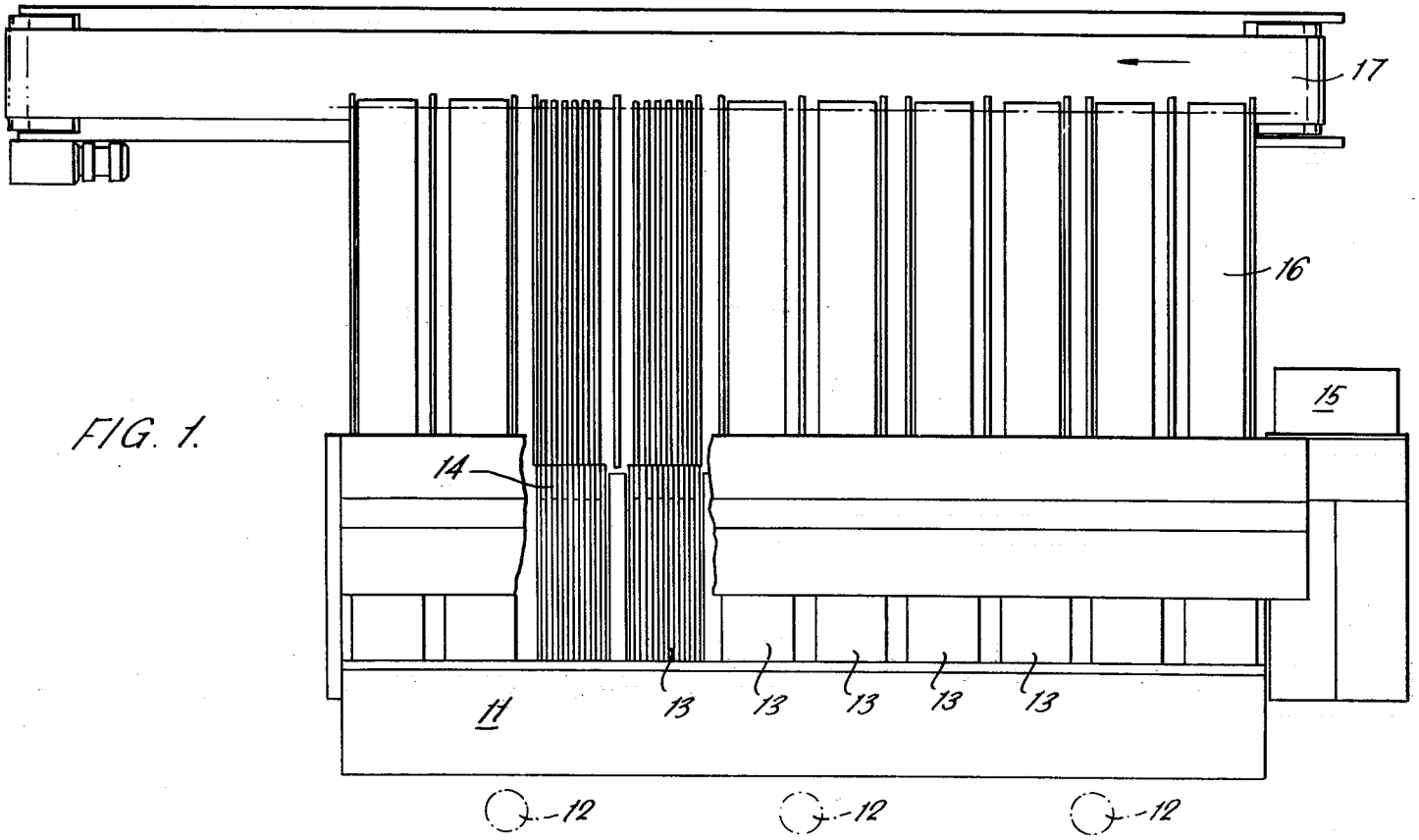

Referring to FIG. 1, the machine consists of a feed-in section 11 fed by a number of operatives 12. They feed the pack units, for example one or more fillets of fish, onto the feed stations 13.

The fish fillets, as required, are then fed towards and onto ten weigh platforms 14 (shown in more detail in FIG. 2), so that all ten weigh platforms each carry one pack unit, which may be one or several fish fillets. Each weigh platform weighs its fillet or fillets and the result is fed to a computer 15.

The object is to provide a packet containing a variable number of fillets each pack having a weight as close as possible to a pre-determined weight acceptability requirement. The computer calculates each combination of sums of the weights from the ten outputs of the weigh platforms, and selects the most desirable combination. The computer can be programmed to operate at the best figure just above the target, or to produce packs in which the mean weight is equal to the target weight within a given tolerance, or any other statistically acceptable figure dependent on local weight laws or the way they are interpreted.

Then, having selected the best combination of weights, an electrical signal causes the fillets at the selected weigh stations to be fed on to a transporter belt system 16, one transporter belt system being provided for each weighhead.

The transporter belt system 16 feed out at progressively faster speeds as one approaches the right hand side of the machine (as seen in FIG. 1). These transporter belt systems 16 then feed to a single output belt 17 feeding to the left. Now, the speed of the belt systems 16 are so related to each other and to the speed of the output belt 17 that the selected group of fillets arrives as a single group at the outlet end of the output belt 17 (to the left of FIG. 1) where they can be packed and will be followed by the next selected combination of fillets which will have similarly become grouped together.

Figure 2:
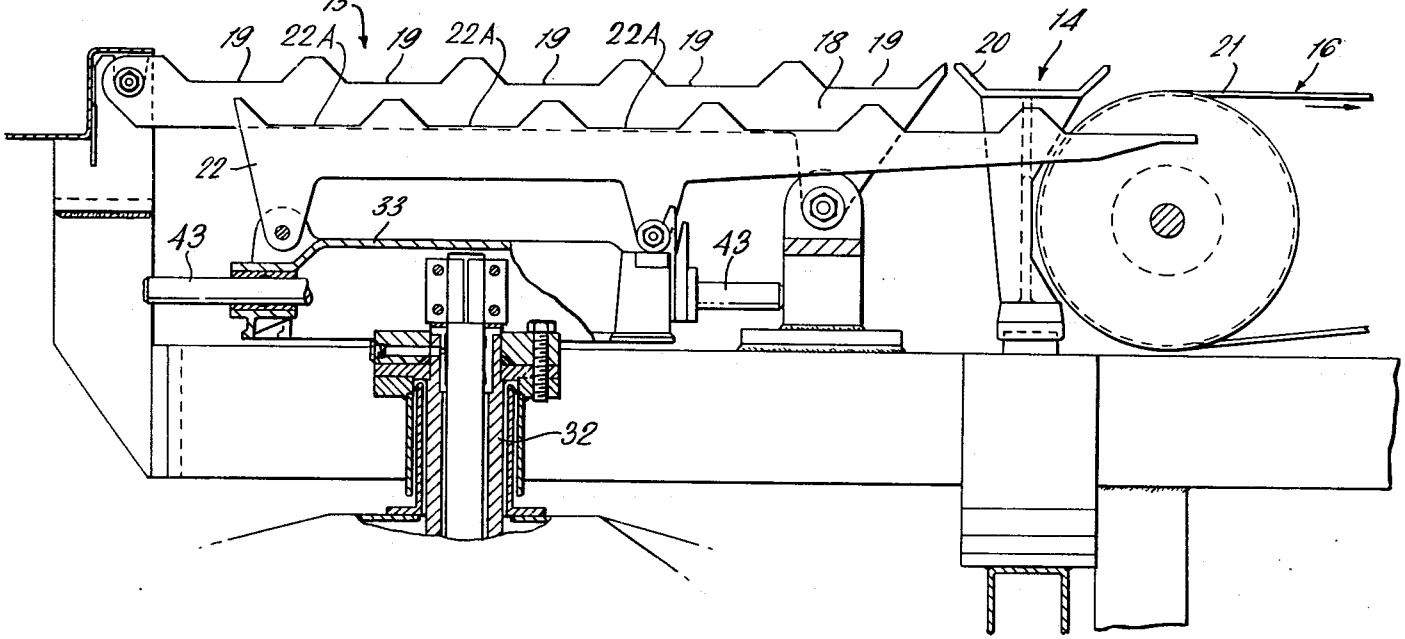
FIG. 2 is a side elevation, part sectional, of the transfer mechanism.
Figure 3:
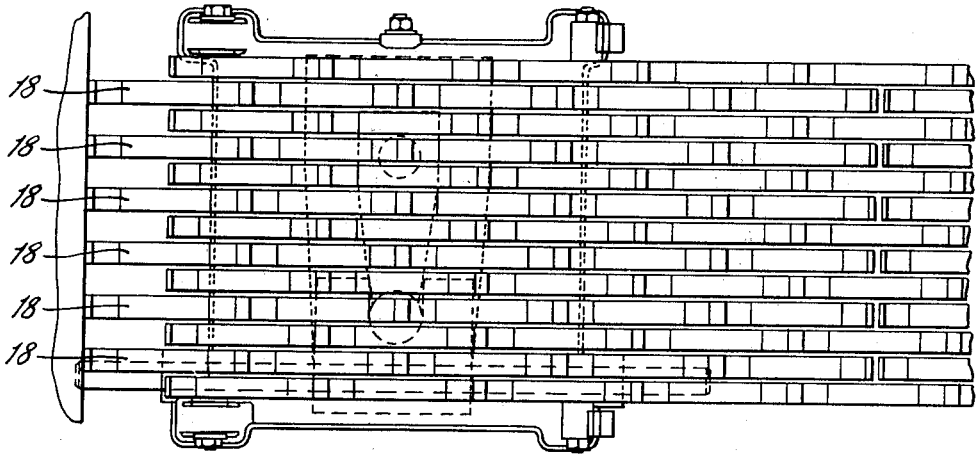
FIG. 3 is a plan view, part broken away, of the transfer mechanism.
Figure 4:
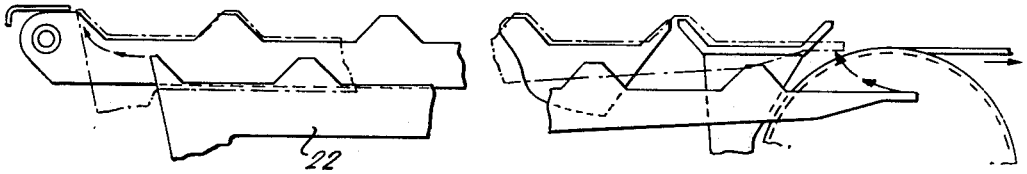
FIGS. 4 to 7 are diagrammatic side views of the transfer motion.
Figure 5:
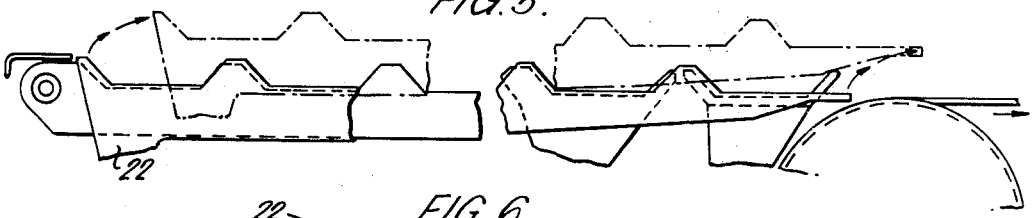
Figure 6:
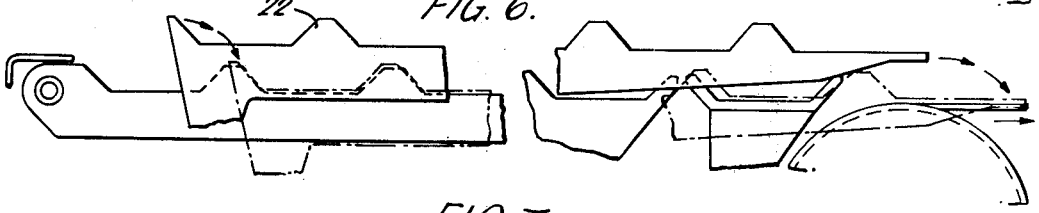
Figure 7:
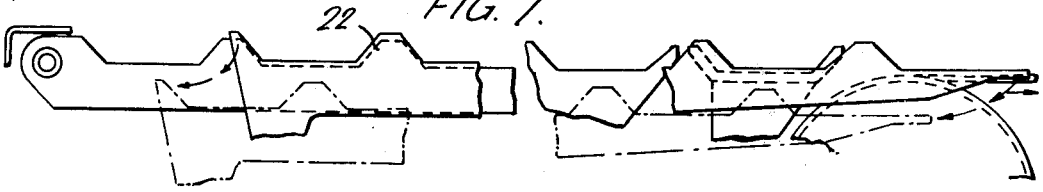

Referring to FIGS. 2 and 3, each of the feed stations 13 is formed from a plurality of parallel spaced carrier bars 18, which each define a series of five troughs 19, each of which is of a size which accommodates a pack unit.

Lying between each of the carrier bars and also extending so as to lie between corresponding parallel bars 20 of the weigh platform and between parallel belts 21 of the feed-out belt system 16, are a series of parallel transfer bars 22.

These transfer bars 22 each have six troughs 22A of similar dimensions to the troughs 19 of the carrier bars 18. The transfer bars are mechanically arranged to be capable of a basically elliptical movement for successively transferring a fish fillet from the first trough of the carrier bar to the next, and progressively along to each of the next three troughs, to the weigh platform and thence to the feed-out belt system 16.

In accordance with the present invention, the movement to provide this elliptical transfer motion is split into separate horizontal and vertical components. The vertical component can then be a continuously reciprocating movement where all transfer bars 22 for all stations move together as one, while the horizontal component only occurs when a movement is required from a selected weighhead (typically three to five of the ten selected by the computer move on).

This has the advantage that, for the vertical movement, a simple combined mechanism operating all bars together can be used, and, moreover, the action of lifting a fillet off and then back on the weighhead will occur simultaneously at all ten weigh platforms each time a transfer takes place. Thus, each time all ten weigh platforms will be actuated to provide a new output reading, and taring to zero for each platform will be effected each time a weighing calculation is to be performed. Moreover, there is less risk of items sticking to the weigh platforms than where the items remain stationary on the platform until selected and thus effecting their accuracy.

On the other hand, for the horizontal transfer motion only those carrier bars which have been selected by the computer will need to be actuated, and so a mechanism dealing with this selective movement is easier to construct, when it is restricted to only that motion which has to occur selectively.

The drive mechanism for these two movements will now be described.

FIGS. 8 and 9 show two offset crank drive systems. A two horsepower motor (not shown) has a single drive shaft 45 which is connected to two offset crank drive wheels 46 and 47 respectively, one for each of the two drive systems. Rotation of the drive wheel 46 of the FIG. 8 mechanism provides a reciprocating movement of a shaft 23 to provide a movement in the direction X. This shaft 23, via extensions 23A, runs the whole length of the machine and provides the drive via an electromagnetic clutch 24 (see FIG. 12) at each station for the horizontal movement of the articles. Operation of the clutch will be described subsequently.

The offset crank drive wheel 47 shown in FIG. 9 rotates to provide for the vertical movement of the articles. It causes reciprocatory movement Y in shaft 25, which (see FIG. 10) connects to a pivoted lever system 26 at each of the stations for providing a vertical movement of a pair of horizontal carrier beams 27 via spaced vertical guides 28. These carrier beams 27 then, by their vertical movement, lift the articles. They also serve as reservoirs for lubricant.

Referring to FIGS. 10 and 11 together, it can be seen that the shaft 25 is connected to a pair of lifting levers 29 via pivots 30 and lever arms 31. Though not shown, the arm 25 extends the whole way along the length of the machine so as to connect to similar lifting mechanisms at each of the ten stations. Thus, the lever system provides an evenly spaced set of lifting members for evenly and uniformly lifting the beams 27 with a simple harmonic vertical oscillation.

Referring now to FIGS. 11 and 2 together, it will be seen that, at each of the ten stations, the horizontal carrier beams carries a hollow support shaft 32 which in turn supports the carrier bars 22 via a supporting box 33. Thus, vertical reciprocation of the shaft 32 causes vertical movement of the box 33 and thence of the transfer bars 22. The carrier bars are pivotally connected to the supporting box to allow access for cleaning.

Coming back now to describe the horizontal movement system, referring to FIGS. 11 and 12, the shaft 23A is connected to a yoke lever 34 to provide a rotary movement about a pivot 35. The yoke lever 34 is carried at the lower end of a solid shaft 36 carried within a hollow shaft 32 and is journalled to freely rotate reciprocally. The shaft 23 connects to the yoke lever 34 at the first station, and pairs of smaller parallel shafts 23A acting in anti-phase transfer the drive on to subsequent stations.

Lying above the yoke lever 34 is a rocker lever 37 which is rigidly connected to the said shaft 36. The lever 37 carries an electro-magnet 38, and the yoke lever 34 carries a spring loaded pole-piece 39 which is located to lock together with the electro-magnet when the magnet is energized, so as to act as an electro-magnetic clutch. Thus, when the electro-magnet is energized the solid shaft rotates reciprocally with the yoke lever, and when de-energized is pushed by the yoke lever to the end of its reciprocal travel (the position shown in solid line in FIG. 12) and then rests at that position.

Figure 13:
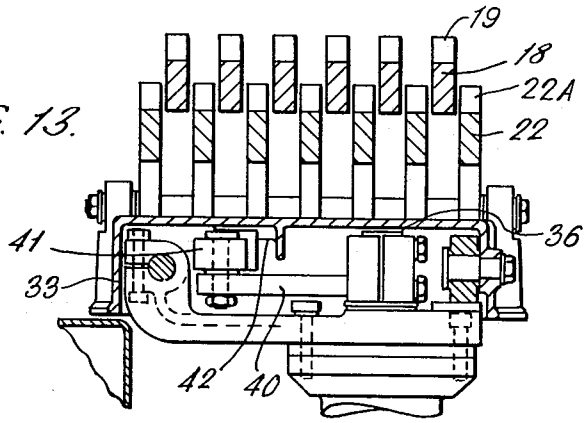
FIG. 13 is a sectional end elevation showing the horizontal drive.

The solid shaft 36 is attached at its upper end to a reciprocating arm 40 (see FIG. 13) carrying a jockey wheel 41 at its outer end which bears against abutments 42 within the box carrier 33. This arrangement is shown dotted in FIG. 3.

The box carrier runs on horizontal guides 43, and thus rotation of the solid shaft causes angular movement of the lever 40 and thence horizontal reciprocal movement of the box carrier 33 which in turn results in the required horizontal movement of the transfer bars 22, with a simple harmonic motion.

In operation, with all conveyors and all transfer mechanisms running, the operatives feed fillets into each of the troughs 19 nearest to them. While each weigh platform is unfilled the computer maintains each appropriate electro-magnet activated, and fillets are therefore fed forward successively until each weigh platform contains a fillet or fillets and can provide a weight output signal. The operatives during this stage will be continuously placing one, two or three fillets (the number being dependent on size) in each trough as it becomes empty through progressive feeding forward towards the weigh platforms.

Then when all weigh platforms are full, the computer will make its calculation as to which combination of fillets produces the most desirable pack weight.

Then the electro-magnets appropriate to the nonselected fillets are de-activated so that at these stations the transfer bars continue to reciprocate vertically but without the horizontal movement. For the selected channels, one cycle of feeding forward takes place resulting in the selected fillets transferring to the transporter belts and then travelling via the output belts to the outlet, while a further group of fillets reach the weigh platform.

There are then once more, ten fillets or groups of fillets at the weigh stations and the process will repeat, operatives successively replenishing the feed-in troughs 19 as necessary.

What is claimed is:

1. For use in a machine having a plurality of feed stations at which individual pack units are supplied to the machine, a feeding mechanism for providing selective shifting of said pack units away from said feed stations, said feeding mechanism comprising:

(a) a plurality of pack transporting conveyor mechanisms for receiving pack units from said feed stations, each of said conveyor mechanisms comprising stationary carrier bars and movable transfer bars, said transfer bars being movable vertically and horizontally relative to said carrier bars; and (b) a drive mechanism including a first drive system connected to all of said transfer bars for establishing a continuous, vertical reciprocating component of movement of all of said transfer bars, said first drive system including a first vertically reciprocable shaft, and a second drive system connected to all of said transfer bars for independently establishing a horizontal reciprocating component of movement of the transfer bars at selected ones of the conveyor mechanisms, said second drive system including a second shaft concentric with said first shaft, said second shaft being capable of rotary movement relative to said first shaft to provide the horizontal reciprocating component of movement at selected ones of the conveyor mechanisms, said first and second drive systems operating in synchronism to establish a pack unit-shifting elliptical movement of transfer bars only at selected conveyor mechanisms.

2. An apparatus according to claim 1 in which the shaft for vertical movement is hollow, and the rotary shaft for the horizontal movement lies within the hollow shaft.

* * * * *